US009909717B2

(12) United States Patent
Frenal et al.

(10) Patent No.: US 9,909,717 B2
(45) Date of Patent: Mar. 6, 2018

(54) GAS SUPPLY DEVICE

(71) Applicant: L'Air Liquide, Société Anonyme pour l'Etude et l'Exploitation des Procédés Georges Claude, Paris (FR)

(72) Inventors: Antoine Frenal, Ezanville (FR); Denis Muller, Rueil Malmaison (FR); Didier Robert, Lyon (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 0 days.

(21) Appl. No.: 15/023,273

(22) PCT Filed: Jul. 30, 2014

(86) PCT No.: PCT/FR2014/051974
§ 371 (c)(1),
(2) Date: Mar. 18, 2016

(87) PCT Pub. No.: WO2015/040295
PCT Pub. Date: Mar. 26, 2015

(65) Prior Publication Data

US 2016/0245460 A1 Aug. 25, 2016

(30) Foreign Application Priority Data

Sep. 19, 2013 (FR) ..... 13 59014

(51) Int. Cl.
*F17C 13/08* (2006.01)
*F17C 5/06* (2006.01)

(52) U.S. Cl.
CPC ..... *F17C 13/084* (2013.01); *F17C 5/06* (2013.01); *F17C 2201/0104* (2013.01);
(Continued)

(58) Field of Classification Search
CPC .. F17C 13/084; F17C 5/06; F17C 2205/0323; F17C 2205/013; F17C 2205/0107;
(Continued)

(56) References Cited

U.S. PATENT DOCUMENTS 2,313,965 A * 3/1943 Pierson ..... F17C 13/084 222/6
3,602,368 A * 8/1971 Gould ..... F17C 13/084 108/55.1
(Continued)

FOREIGN PATENT DOCUMENTS

DE 196 19 779 11/1996
DE 2010 3682 5/2001
(Continued)

OTHER PUBLICATIONS

French Search Report for FR1359014, mailed Jun. 25, 2014.
(Continued)

*Primary Examiner* — Nicolas A Arnett
(74) *Attorney, Agent, or Firm* — Elwood L. Haynes

(57) ABSTRACT

Device for supplying gas comprising a support frame (2) housing a plurality of pressurized-fluid cylinders (3) connected to a fluidic circuit (4, 5) for withdrawing from or filling the cylinders (3), said circuit (4, 5) comprising at least a first connection end (6) connected to the cylinders (3) via a first isolation valve (7) to allow filling of and withdrawal from the cylinders (3), the support frame (2) comprising a base (34) on which the cylinders (3) rest and a set of uprights (30) and transverse beams (31, 32, 33) defining a cage of parallelepipedal overall shape to hold the cylinders (3), the frame (2) comprising, on one of the lateral faces thereof referred to as the "front" face (35), an interface panel (20) comprising at least one opening (23, 24, 25) providing access to the circuit (4, 5), characterized in that the lateral face referred to as the "rear" face (36) of the frame (2),
(Continued)

which face is situated opposite the front face (35), is delimited by uprights (30) longer than the uprights (30) of the front face, which means to say that the rear face (36) is taller than the front face (35).

11 Claims, 3 Drawing Sheets

(52) U.S. Cl.
CPC .. *F17C 2201/032* (2013.01); *F17C 2201/056* (2013.01); *F17C 2205/013* (2013.01); *F17C 2205/0107* (2013.01); *F17C 2205/0111* (2013.01); *F17C 2205/0142* (2013.01); *F17C 2205/0188* (2013.01); *F17C 2205/0323* (2013.01); *F17C 2205/0329* (2013.01); *F17C 2205/0338* (2013.01); *F17C 2250/043* (2013.01); *F17C 2260/013* (2013.01); *F17C 2270/01* (2013.01)

(58) Field of Classification Search
CPC ..... F17C 2205/0111; F17C 2205/0142; F17C 2205/0188; F17C 2205/0338; F17C 2205/0329; F17C 2201/0104; F17C 2250/043; F17C 2260/013; F17C 2270/01; F17C 2201/032; F17C 2201/056
See application file for complete search history.

(56) References Cited

U.S. PATENT DOCUMENTS 3,934,926 A * 1/1976 Bennett ..... B60P 3/055 410/80
3,993,344 A * 11/1976 Bennett ..... B60P 3/055 108/55.1
4,061,391 A 12/1977 Violette
4,295,431 A * 10/1981 Stavlo ..... B65D 19/08 108/55.1
4,542,774 A * 9/1985 Stavlo ..... B60P 3/2265 141/1
4,564,109 A * 1/1986 Stavlo ..... B65D 19/08 206/391
4,642,007 A * 2/1987 Marshall ..... B60P 3/055 296/183.1
4,967,934 A 11/1990 Andonian
5,078,415 A * 1/1992 Goral ..... B62B 3/104 108/55.1
5,176,265 A * 1/1993 Bennett ..... A47F 7/28 108/55.5
5,292,012 A * 3/1994 Davis ..... B60P 3/2205 211/85.18
5,404,921 A 4/1995 Lamoreaux et al.
5,573,360 A * 11/1996 Bennett ..... B60P 7/13 410/36
5,954,099 A * 9/1999 Princiotta ..... B60P 3/055 141/18
5,975,121 A 11/1999 Arzenton et al.
6,059,127 A * 5/2000 Bennett ..... B62B 3/02 211/85.18
6,067,913 A 5/2000 Bennett
6,405,882 B1 * 6/2002 Baxter ..... B63C 11/18 211/74
6,494,549 B2 * 12/2002 Van Daalwyk ..... F17C 13/084 211/81
6,685,404 B2 * 2/2004 Udivich ..... B60P 3/055 211/85.18
7,017,741 B1 * 3/2006 Williamson ..... F17C 13/084 206/386
7,070,372 B2 * 7/2006 Denike ..... F17C 13/084 211/85.18
7,275,902 B1 * 10/2007 Klotz ..... B60P 3/055 410/32
7,707,795 B2 * 5/2010 Yu ..... E04B 2/7422 403/402
7,997,213 B1 * 8/2011 Gauthier ..... B65D 88/022 108/53.1
8,016,300 B2 * 9/2011 Cramer ..... B62B 5/049 137/899.3
2008/0110784 A1 5/2008 Nowicki
2009/0200333 A1 * 8/2009 Bauer ..... B60P 3/14 222/1
2009/0283351 A1 11/2009 Cannet et al.
2011/0049194 A1 3/2011 Cannet et al.
2012/0175375 A1 7/2012 Ligonesche et al.
2012/0261425 A1 10/2012 Lang et al.
2014/0026991 A1 1/2014 Verghade et al.
2014/0290797 A1 * 10/2014 Kriese ..... F17C 13/084 141/99
2015/0308620 A1 * 10/2015 Frenal ..... F17C 1/02 137/255

FOREIGN PATENT DOCUMENTS

DE 20 2004 000771 4/2004
DE 10 2011 014 065 9/2012
DE 10 2012 004391 9/2013
FR 2 735 209 12/1996
FR 2 828 922 2/2003
FR 2 970 314 7/2012
FR 2 985 802 7/2013
GB 2007 348 5/1979
WO WO 2007 146 871 12/2007

OTHER PUBLICATIONS

International Search Report (English) for corresponding PCT/FR2014/051947, mailed Feb. 25, 2015.
Written Opinion (French) for corresponding PCT/FR2014/051947 (with English translation),C3 mailed Feb. 25, 2015.
French Search Report for related FR 1359018, dated Jul. 14, 2014.
International Search Report and Written Opinion for related PCT/FR 2014/052196, dated Nov. 14, 2014.

* cited by examiner

GAS SUPPLY DEVICE

CROSS REFERENCE TO RELATED APPLICATIONS

This application is a 371 of International PCT Application PCT/FR2014/051974 filed Jul. 30, 2014, which claims priority to French Patent Application No. 1359014 filed Sep. 19, 2013, the entire contents of which are incorporated herein by reference.

BACKGROUND

The present invention concerns a gas supply device. More particularly, the invention concerns a device for supplying gas or fluid, comprising a support frame accommodating a plurality of pressurized fluid cylinders connected to a fluidic circuit to ensure the extraction from or filling of the cylinders, said circuit comprising at least one first connecting end connected to said cylinders via a first isolating valve to allow the filling of and extraction from the cylinders, the support frame comprising a base on which the cylinders rest, and a set of uprights and transverse beams defining a cage of generally parallelepipedic form for holding the cylinders, the frame comprising, on one of its side faces called the front face, an interface panel comprising at least one opening for access to the circuit.

The invention also concerns gas supply devices sometimes known as frames.

Such a device is described for example in documents DE20103682U1, GB2007348 A1 or DE102011014065 A1.

Such devices generally use a bundle of cylinders which store gas at high pressure, for example 200 bar, 300 bar or above.

These devices must comply with various requirements which are often contradictory, for example a cylinder filling circuit compatible with the high flows and pressures and allowing satisfactory mixtures of gas (in terms of homogeneity and/or filling time in particular), an extraction circuit offering safety of use for the user, good ergonomics for the user limiting the risk of accident, easy handling of the frame limiting the risks of accident, in particular in the case where the frames are transported strapped onto vehicles.

SUMMARY

One aim of the present invention is to remedy all or part of the drawbacks of the prior art outlined above.

To this end, the gas supply device according to the invention, otherwise in accordance with the generic definition given by the preamble above, is essentially characterized in that the side face called the rear face of the frame, which is situated opposite the front face, is delimited by uprights having a length greater than the length of the uprights of the front face, i.e. the rear face has a height greater than the height of the front face.

Also, embodiments of the invention may comprise one or more of the following characteristics:

- the frame comprises upper transverse beams situated at the level of the upper end of the frame and connecting the uprights two by two respectively,
- the upper end of the frame comprises at least one and preferably at least two vertical protrusions protruding upward relative to the upper transverse beams, the vertical protrusion(s) protruding relative to the upper transverse beams by a distance of between two and twenty millimeters in order to form a stop for support straps intended to be arranged over and around the frame in the rear-front direction,
- the protrusion(s) are formed by the upper end(s) of the uprights of the frame,
- the upper transverse beams connecting an upright of the rear face to an upright of the front face have rear ends situated above the front ends,
- the upper transverse beams connecting an upright of the rear face to an upright of the front face are inclined downward from the rear to the front,
- the upper transverse beams connecting an upright of the rear face to an upright of the front face are curved with the concavity oriented towards the base of the frame,
- the frame comprises a central post, the lower end of which is fixed to the central part of the base and the upper end of which comprises a handling ring for the cage which protrudes beyond the parallelepipedic volume of the cage,
- at least a part of the at least one of the faces of the cage (side or upper faces) comprises a grid and/or a solid partition,
- the frame comprises intermediate and lower transverse beams situated halfway up and in the lower part of the frame respectively and connecting the uprights two by two respectively,
- the base comprises a raised floor structure provided with securing openings.

The invention may also concern any alternative device or method comprising any combination of the characteristics above or below.

BRIEF DESCRIPTION OF THE DRAWINGS

Further features and advantages will appear from reading the description which follows, given with reference to the figures in which.

DESCRIPTION OF PREFERRED EMBODIMENTS

Figure 1:
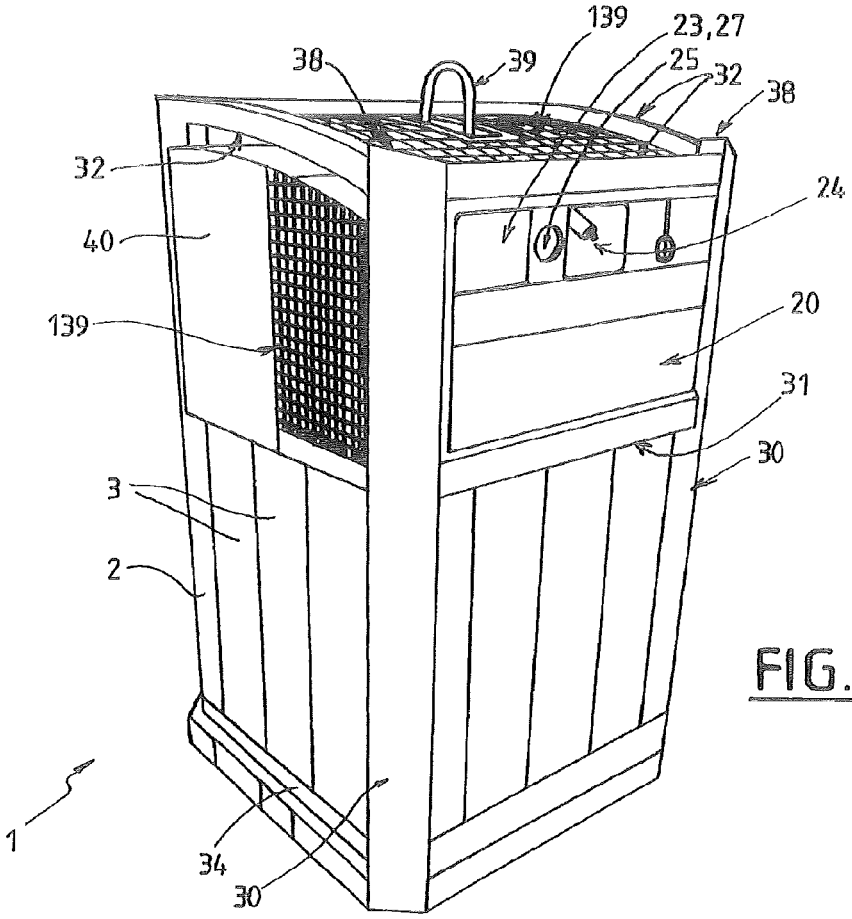
FIG. 1 shows a perspective, diagrammatic and partial view, illustrating a possible exemplary embodiment of the invention.
Figure 5:
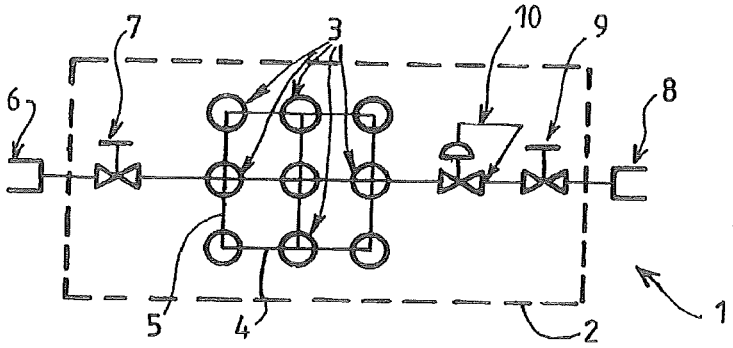
FIG. 5 shows a diagrammatic and partial view illustrating the structure of a possible exemplary embodiment of the invention.

The gas supply device 1 shown diagrammatically in FIG. 1 and in perspective in FIG. 5 conventionally comprises a support frame 2, comprising for example a framework of generally parallelepipedic form, accommodating a plurality of pressurized fluid cylinders 3.

For example, the cylinders 3 are arranged in a bundle vertically on a base 130. The openings of the cylinders 3 are connected to a fluidic circuit 4, 5 for ensuring the extraction or filling of the cylinders 3 (cf. FIG. 5).

For example, the circuit 4, 5 comprises a first connecting end 6 connected to the cylinders 3 via a first isolating valve 7 to allow the filling of and extraction from the cylinders 3. The circuit may comprise a second, separate, connecting end 8 connected to the openings of the cylinders 3 via a second isolating valve 9 and a pressure relief valve 10.

As illustrated as an example in FIG. 5, the pressure relief valve 10 and the isolating valve 9 are arranged in series in this order between the cylinders 3 and the second connecting end 8. Naturally it is possible to consider placing the second isolating valve 9 upstream of the pressure relief valve 10 (i.e. between the cylinders 3 and the pressure relief valve 10). The second connecting end 8 is provided to allow extraction of the fluid.

The frame 2 comprises a set of four vertical uprights 30, the lower ends of which are connected respectively to the four corners of the square (or parallelepipedic) base.

The vertical uprights 30 may have a U-shaped or parallelepipedic cross-section and be oriented to present a flat surface at the level of the vertical edges of the frame 2.

Figure 4:
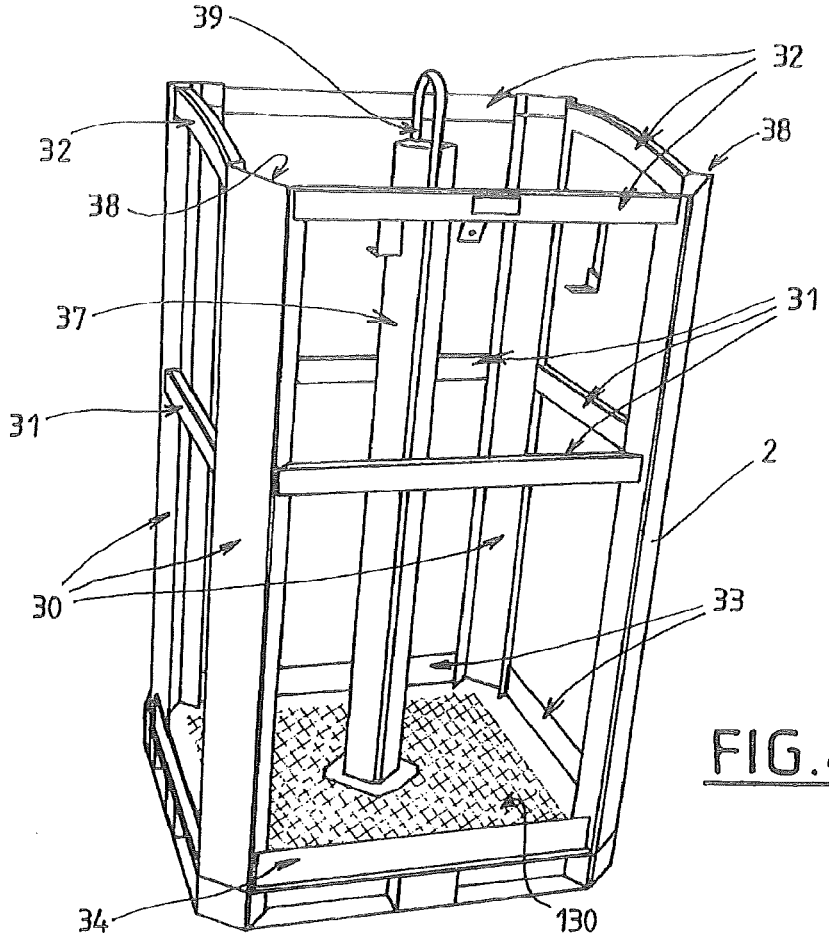
FIG. 4 shows a perspective, diagrammatic and partial view of the device of FIG. 1, illustrating the skeleton structure of the frame.

The frame 2 also comprises horizontal transverse beams 31, 32, 33 on the side faces of a cage of generally parallelepipedic form, for holding the cylinders 3 (cf. FIG. 4).

In particular, the frame 2 may comprise four lower transverse beams 33, four intermediate transverse beams 31, and four upper transverse beams 32.

As illustrated in FIG. 1, at least part of the at least one face of the frame (side or upper faces) may be open-worked at least partially by a grid 139 and/or be a solid partition 40 fixed to the uprights 30 and the transverse beams.

The frame 2 comprises, on one of its side faces known as the front face 35, an interface panel 20 comprising at least one opening and, as described in more detail below, preferably a plurality of openings 23, 24, 25 for access to the circuit 4, 5 and in particular the elements of the circuit.

According to one advantageous feature, the rear side face 36 of the frame 2, i.e. the side face situated opposite the front face 35, is delimited by uprights 30 having a length (height) greater than the length (height) of the uprights 30 of the front face 35. This means that the rear face 36 has a height greater than the height of the front face 35.

This allows the user to distinguish, even from a distance, the functional front face from the other faces of the frame. In particular, this facilitates identification of and access to the user interfaces for the operators (e.g. control panel, valves and connections etc.). The ergonomics of the device are improved.

Furthermore, this difference in height between the front and the rear of the frame 2 has other advantages. In fact, this configuration prevents a user from stacking several devices. Furthermore, in the typical case where two devices 1 are strapped back to back in a vertical plane on a support 40, such as a truck trailer, via one or more straps 42, this architecture generates oblique forces on the frames 2 in an oblique fashion, tending to hold them back to back. This further limits the risk of tilting of the frames 2.

The upper end of the frame 2 may comprise, in addition, at least one and preferably at least two vertical protrusions 38 protruding upward relative to the transverse beams 32, in order to form a stop preventing the lateral slippage of the straps 42. For example, these vertical protrusions protrude beyond the roof of the frame by 2 to 20 mm.

Figure 2:
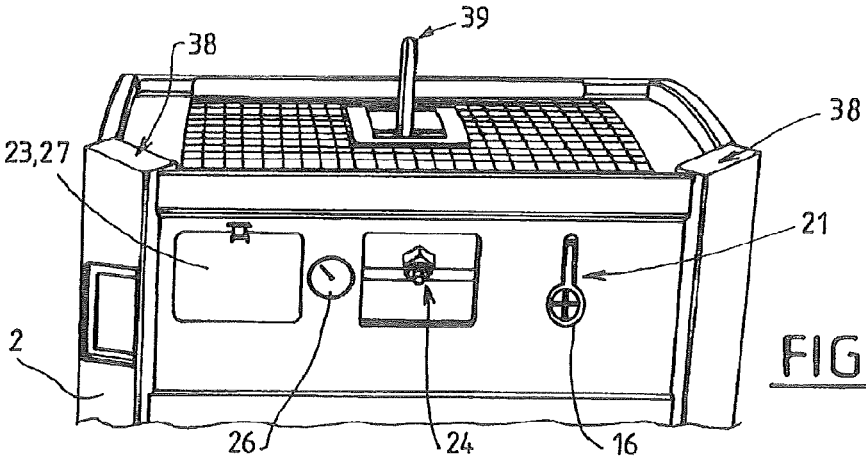
FIG. 2 shows a perspective, diagrammatic and partial view of a detail of the device from FIG. 1, illustrating the upper part of its front face.
Figure 3:
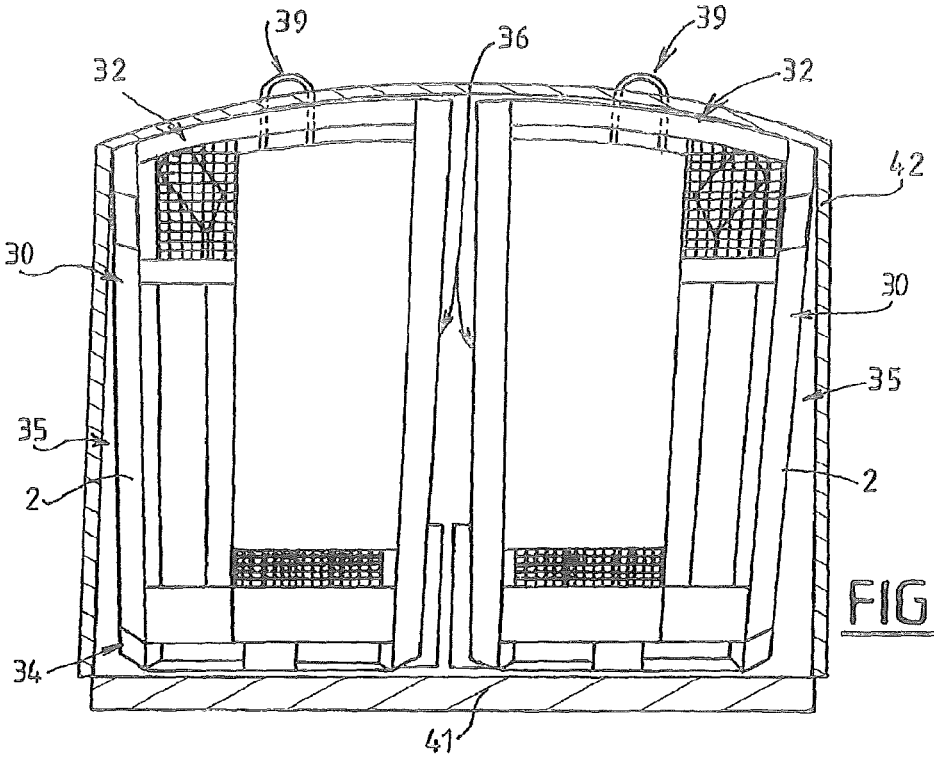
FIG. 3 shows a side view, diagrammatic and partial, illustrating two gas supply devices placed back to back and strapped to a support.

As illustrated in FIG. 2, the protrusions may comprise upper ends 38 of at least the two uprights 30 of the front face.

The support zone of the straps 40 may be delimited or concave to avoid any risk of slippage of the straps outside the frame 2.

Figure 6:
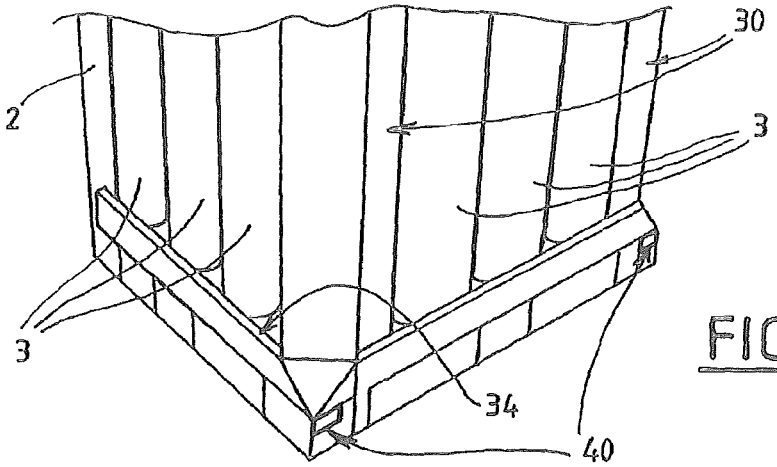
FIG. 6 shows a perspective, diagrammatic and partial view of a detail of the device of FIGS. 1 and 3, illustrating a possible exemplary embodiment of the lower part of the device.

As illustrated in FIG. 6, at least one face (for example, the rear of the base 40 of the frame 2) may comprise securing zones, for example two securing openings 40.

The upper transverse beams 32, connecting an upright 30 of the rear face to an upright 30, may thus be rectilinear and inclined downward from rear to front and/or curved with the concavity oriented towards the base 34.

The frame 2 may comprise a central post 37, the lower end of which is fixed to the central part of the base 130 and the upper end of which comprises a handling ring 39 for the frame which protrudes beyond the parallelepipedic volume of the cage (cf. FIGS. 1 to 4).

This central post 37 may receive the lifting forces on handling of the frame 2. This avoids the use of lifting cables and elevated intervention operations. This structure also lightens the structure, since it allows separation of the lifting function (traction) from that linked to fall resistance and lateral protection. The upper part of the frame 2 is free to allow easy introduction of a preassembled circuit 4, 5 which is introduced into the frame from above. This limits the assembly time in production. This structure also helps hold the cylinders, limiting the risk of stress/mechanical fatigue during handling.

As shown in FIGS. 1 and 2, the interface panel 20 of the front face may integrate openings 23, 24, 24, 21 for access respectively to a filling connection (first end 6 of the circuit), an extraction connection (second end 8 of the circuit), a manometer and a control unit 16 for an isolating valve 9. At least one 23 of the openings may be selectively sealed or opened via a movable cover 27.

The upper geometry of the frame 2 allows improvement of the shock resistance of the frame, as described below.

The uprights 30 (in particular their upper part and the relative arrangement) are thus provided to deform under the impact of the shock in the case of tilting of the assembly of the frame from a height equivalent to that of a semitrailer or loading dock.

This deformation of the uprights in case of falling of the frame 2 allows absorption of part of the impact energy. This means that only part of the frame's deceleration is transmitted to the cylinders and their fixings.

This helps preserve the gas circuit 4, 5 of the frame by avoiding excessive deformation thereof due to the displacement of the cylinders relative to each other.

This allows a significant limitation in the risks of gas leakage under high pressure.

The resulting deformation of the frame 2 also protects the frame from impact against the pressurized gas control elements (such as valves, pressure relief valves etc.), thus helping conserve the integrity of the high-pressure gas circuit.

Thus, while being simple in construction and inexpensive, the device has a number of advantages in comparison with known systems.

The invention claimed is:

1. A gas supply device comprising a support frame accommodating a plurality of pressurized fluid cylinders connected to a fluidic circuit to ensure the extraction from or filling of the cylinders, the circuit comprising, at least one first connecting end connected to said cylinders via a first isolating valve to allow the filling of and extraction from the cylinders, the support frame comprising, a base on which the cylinders rest, and a set of uprights and transverse beams defining a cage of generally parallelepipedic form for holding the cylinders, the frame comprising, on one of its side faces called the front face, an interface panel comprising at least one opening for access to the circuit wherein the side face called the rear face of the frame, which is situated opposite the front face, is delimited by uprights having a length greater than the length of the uprights of the front face, has a height greater than the height of the front face, and in that the upper transverse beams connecting an upright of the rear face to an upright of the front face are inclined downward from the rear to the front and/or are curved with the concavity oriented towards the base of the frame.

2. The device of claim 1, wherein the frame comprises upper transverse beams situated at the level of the upper end of the frame and connecting the uprights two by two respectively.

3. The device of claim 2, wherein the upper transverse beams connecting an upright of the rear face to an upright of the front face have rear ends situated above the front ends.

4. The device of claim 1, wherein the upper end of the frame comprises at least one vertical protrusion protruding upward relative to the upper transverse beams, the vertical protrusion protruding relative to the upper transverse beams by a distance of between two and twenty millimeters in order to form a stop for support straps intended to be arranged over and around the frame in the rear-front direction.

5. The device of claim 4, wherein the protrusion are formed by the upper end of the uprights of the frame.

6. The device of claim 1, wherein the interface panel of the front face integrates openings for access respectively to a filling connection, an extraction connection, a manometer and a control element for the isolating valve.

7. The device of claim 6, wherein at least one of the openings is sealed or opened via a movable cover.

8. The device of claim 1, wherein the frame comprises a central post, the lower end of which is fixed to the central part of the base and the upper end of which comprises a handling ring for the cage which protrudes beyond the parallelepipedic volume of the cage.

9. The device of claim 1 wherein at least a part of the at least one of the faces of the cage comprises a grid and/or a solid partition.

10. The device of claim 1, wherein the frame comprises intermediate and lower transverse beams situated halfway up and in the lower part of the frame respectively and connecting the uprights two by two respectively.

11. The device of claim 1, wherein the base comprises a raised floor structure provided with securing openings.

* * * * *